US011772413B1

(12) United States Patent
Castorina

(10) Patent No.: US 11,772,413 B1
(45) Date of Patent: Oct. 3, 2023

(54) PAINT ROLLER HOUSING

(71) Applicant: Devin James Castorina, Pinellas Park, FL (US)

(72) Inventor: Devin James Castorina, Pinellas Park, FL (US)

( * ) Notice: Subject to any disclaimer, the term of this patent is extended or adjusted under 35 U.S.C. 154(b) by 0 days.

(21) Appl. No.: 17/658,291

(22) Filed: Apr. 7, 2022

(51) Int. Cl.
*B44D 3/00* (2006.01)

(52) U.S. Cl.
CPC ..... *B44D 3/006* (2013.01)

(58) Field of Classification Search
None
See application file for complete search history.

(56) References Cited

U.S. PATENT DOCUMENTS 5,363,869 A * 11/1994 McDowell ..... B44D 3/006 134/900
5,402,808 A * 4/1995 Wallis ..... B44D 3/006 134/900
7,806,129 B2 * 10/2010 Jabbar ..... B44D 3/006 134/900

* cited by examiner

*Primary Examiner* — Rita P Adhlakha
(74) *Attorney, Agent, or Firm* — Inventions International Inc.; Tiffany C. Miller

(57) ABSTRACT

A paint roller housing having a chamber. The chamber of the housing has a first end located opposite a second end. The first end has a first opening configured to receive at least a portion of both a paint roller frame and a paint roller cover. The second end of the housing has a port. The housing has a substantially planar wall that is perpendicular to the first end and the second end of the housing. The substantially planar wall has a second opening that abuts the first opening of the first end of the housing. The second opening is configured for the paint roller frame to slidably traverse the length of the second opening to orient the paint roller cover within the chamber of the housing. The housing has a radial wall having a third opening and a guide ramp located within the chamber of the housing.

11 Claims, 8 Drawing Sheets

PAINT ROLLER HOUSING

BACKGROUND OF THE INVENTION

1. Field of the Invention

This invention relates, generally, to a paint roller housing. More particularly, it relates to a housing having a compartment with an opening configured to receive a paint roller to be retained within the compartment during the cleaning process of the paint roller.

2. Background Art

Currently, in the paining industry, a paint roller has a frame. The paint roller frame has a ribbed end potion receiving a removable roller cover located opposite a handle portion. When the roller cover has been exposed to and is covered with paint during use, it is common for a user to throw away the roller cover. This is costly as it requires additional expense for additional material cost. It is more desirable for a user to quickly and efficiently clean a used roller cover so that it may be reused for a subsequent project. Thus, there is a need for a paint roller housing capable of In some instances a paint roller cover may be directly rinsed with water from a hose or other water source. This causes paint from the used paint roller cover to splatter to the surrounding area such as a job site or inside a wash basin or sink, which is messy and may stain clothing or personal property. Thus, there is a need for a paint roller housing configured to retain a paint roller cover and a paint roller frame within a chamber to reduce the mess while being cleaned with water from a hose. This will result in the splatter mess from the paint on the roller cover being retained within the housing rather than over spraying to the surrounding areas.

However, in view of the prior art considered as a whole at the time the present invention was made, it was not obvious to those of ordinary skill in the pertinent art how the identified needs could be fulfilled.

SUMMARY OF THE INVENTION

The long-standing but heretofore unfulfilled need for a paint roller housing having a housing with a chamber. The chamber of the housing has a first end located opposite a second end. The first end of the housing has a first opening. The first opening of the housing is configured to receive at least a portion of both a paint roller frame and a paint roller cover. The second end of the housing has at least one port. The housing also has a substantially planar wall that is perpendicular to the first end and the second end of the housing. The substantially planar wall has a second opening that abuts the first opening of the first end of the housing. The second opening is configured for the paint roller frame to slidably traverse the length of the second opening to orient the paint roller cover within the chamber of the housing. The housing has a radial wall having a third opening and a guide ramp located within the chamber of the housing, and which also includes improvements that overcome the limitations of prior art paint roller housings is now met by a new, useful, and non-obvious invention.

In another embodiment, the housing has a sealing structure bordering the second opening of the planar wall of the housing.

In another embodiment, the second end of the housing has at least one opening. It is within the scope of the current invention for the second end of the housing to have a plurality of openings sufficient enough to drain or remove or expel the paint contaminated water from the chamber of the housing into, for example, a 5-gallon bucket, a bucket, or the ground.

In another embodiment, the housing is removably connected to an outer perimeter edge bordering an opening of a bucket. The housing can have a tapered end portion. In particular, the lower portion of the housing, including the second end of the housing, is tapered and is retained by the bucket.

In another embodiment, the housing is removably connected to a bucket. The second end of the housing has a flange. The flange is connected to a bucket.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Figure 1:
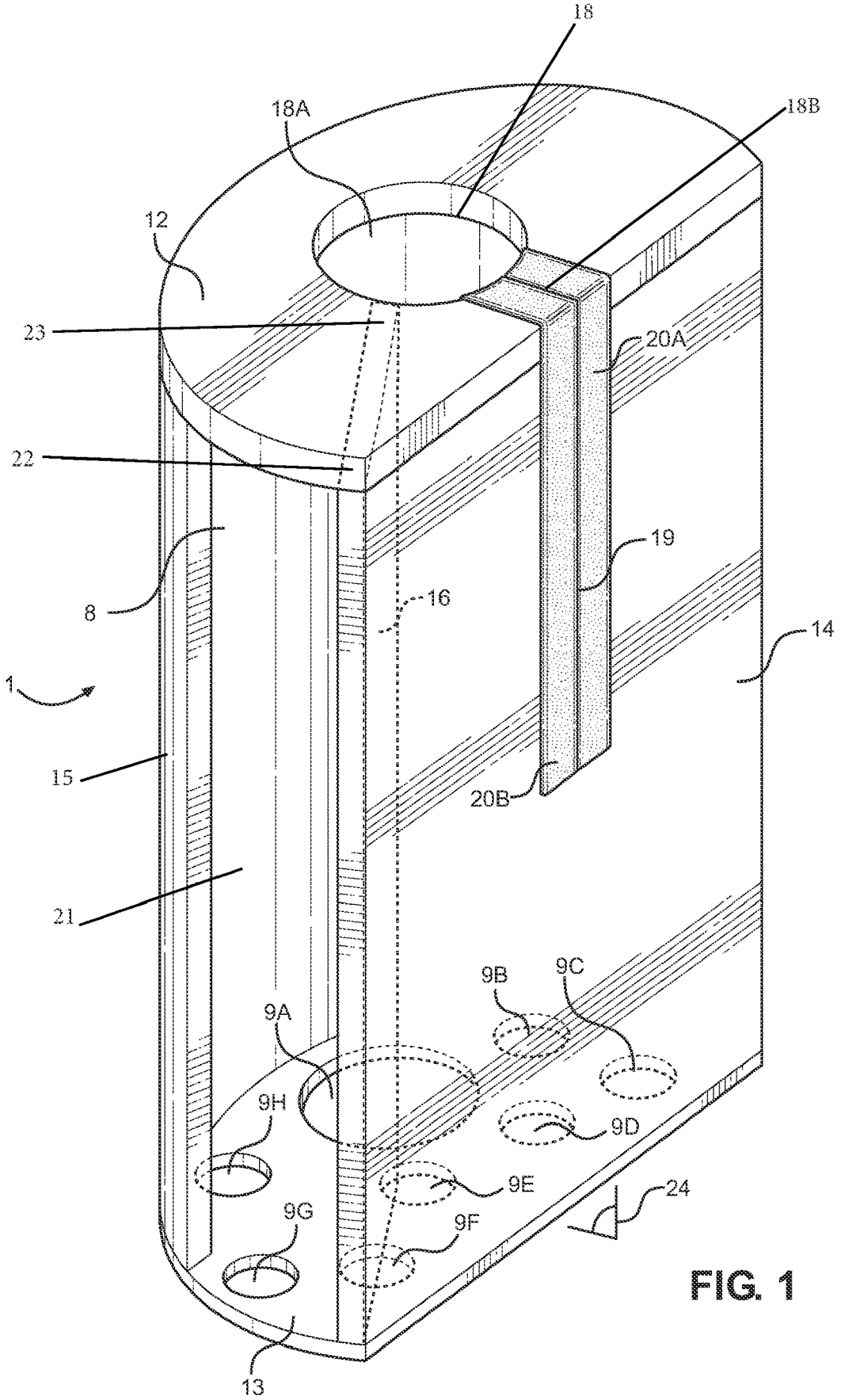
FIG. 1 is a sectional top view of the novel paint roller housing having a chamber and a guide ramp.
Figure 2:
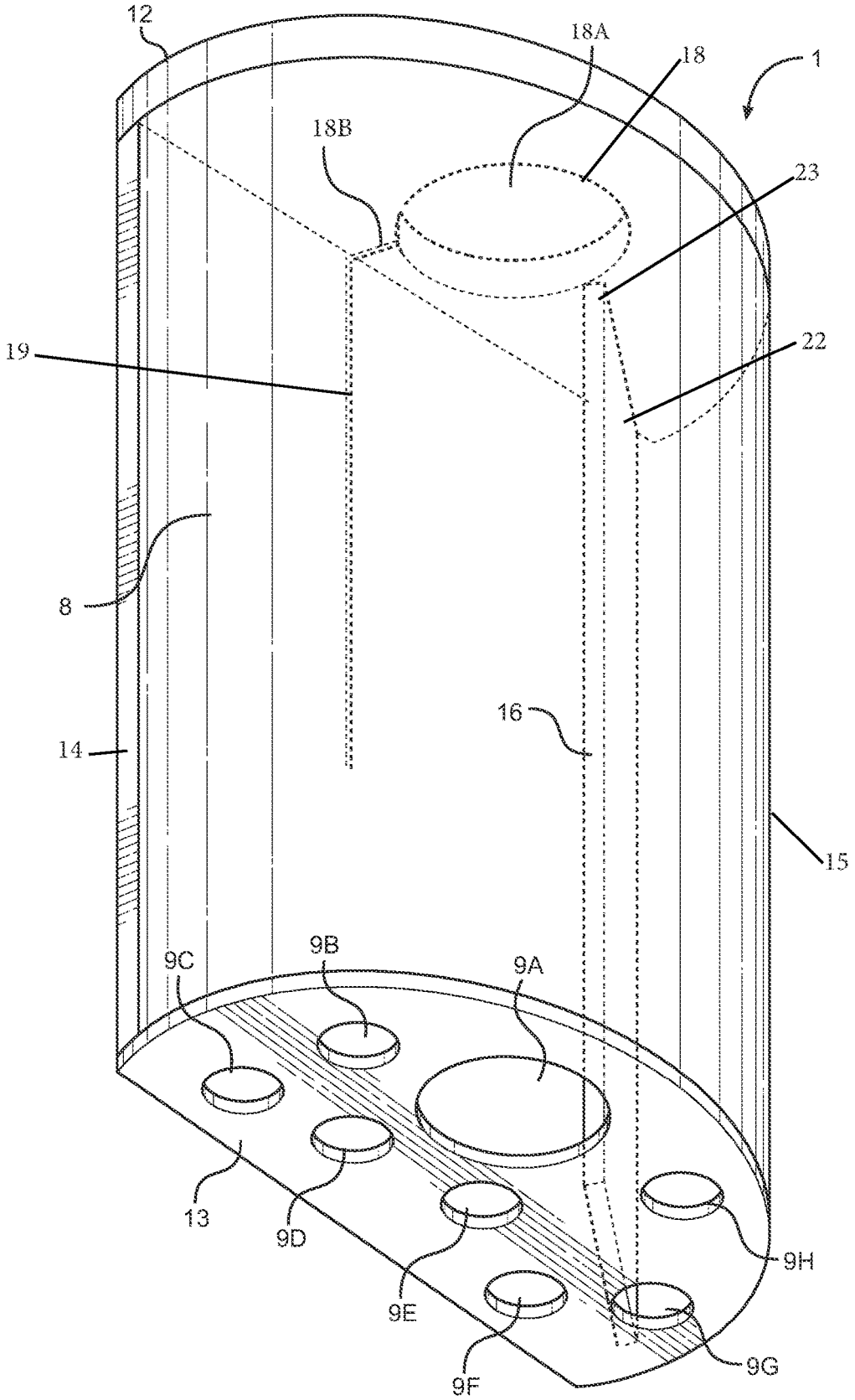
FIG. 2 is a sectional rear view of the novel paint roller housing having a chamber and a guide ramp.
Figure 3:
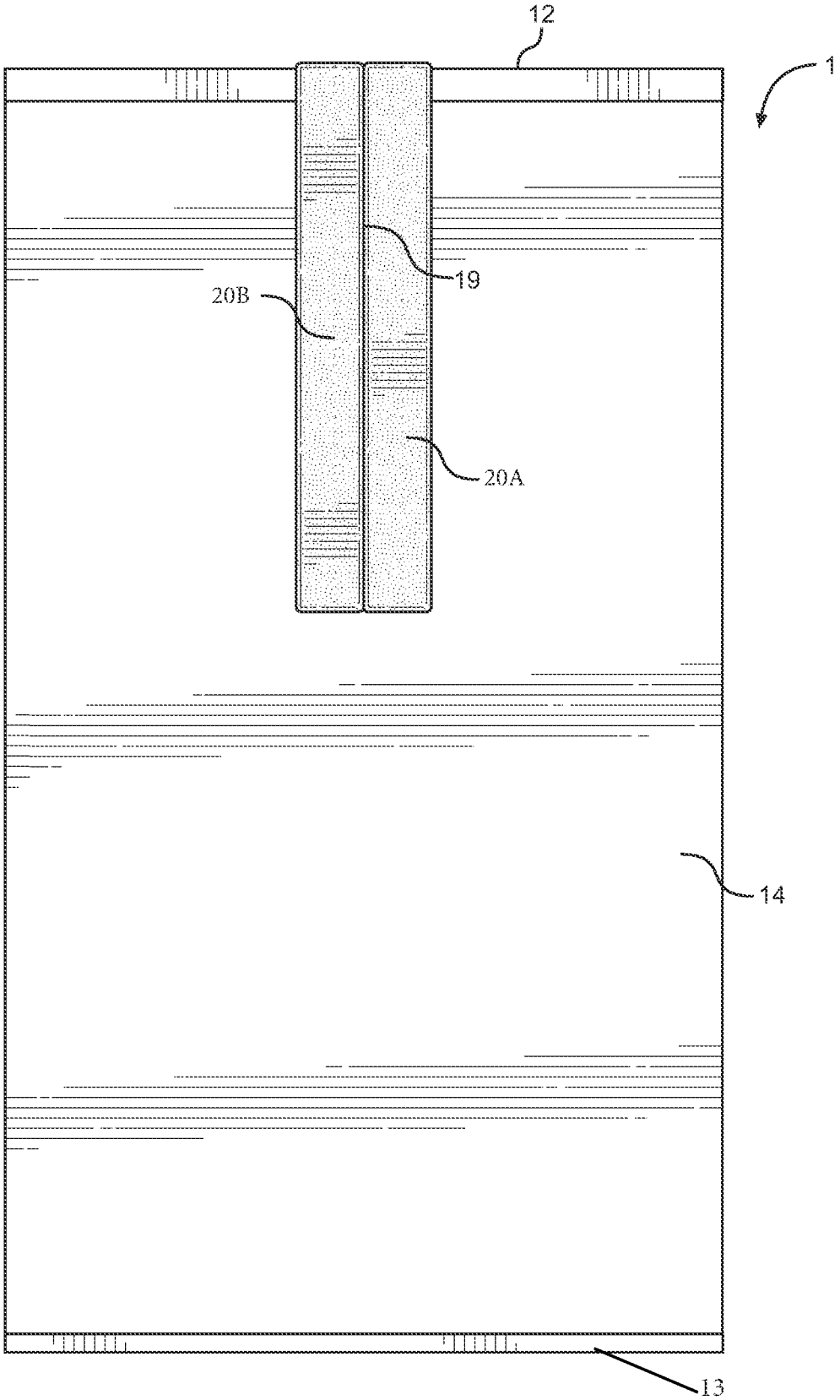
FIG. 3 is a side perspective view of the sealing structure located on a planar wall surface of the novel paint roller housing.
Figure 4:
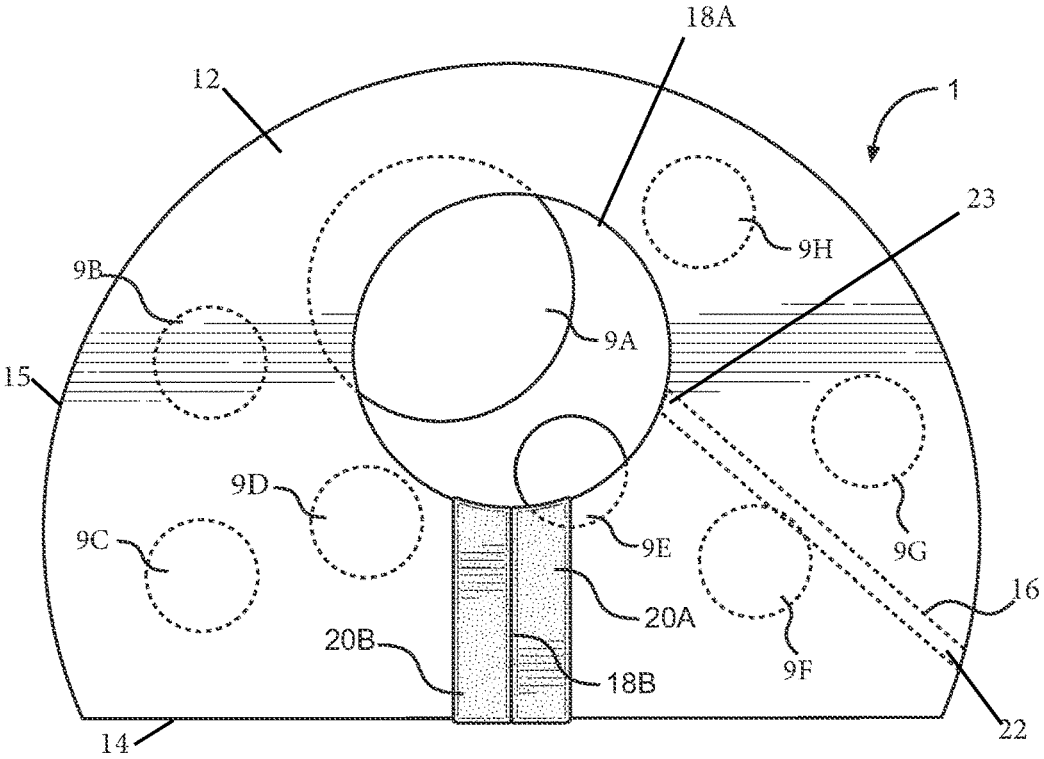
FIG. 4 is a top sectional view of the novel paint roller housing.
Figure 5:
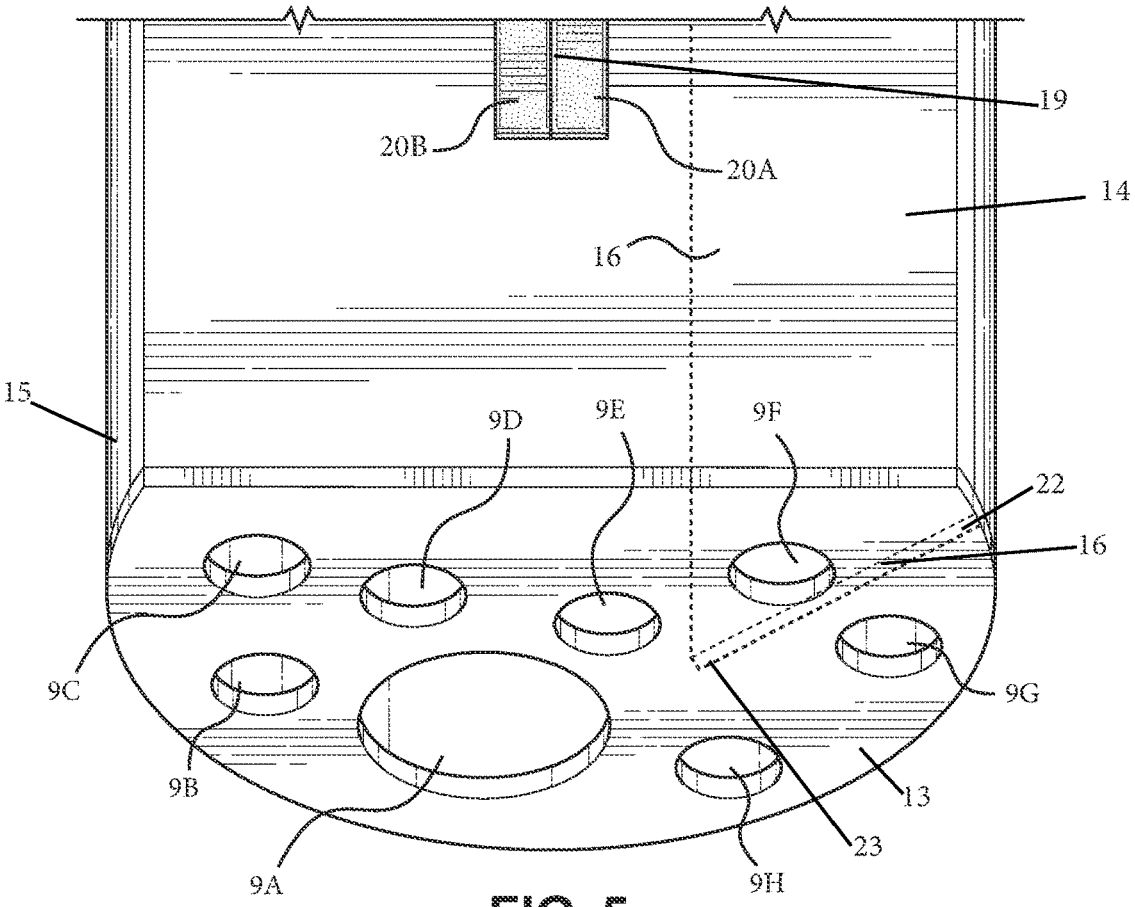
FIG. 5 is a partial rear sectional view of the novel paint roller housing.
Figure 6:
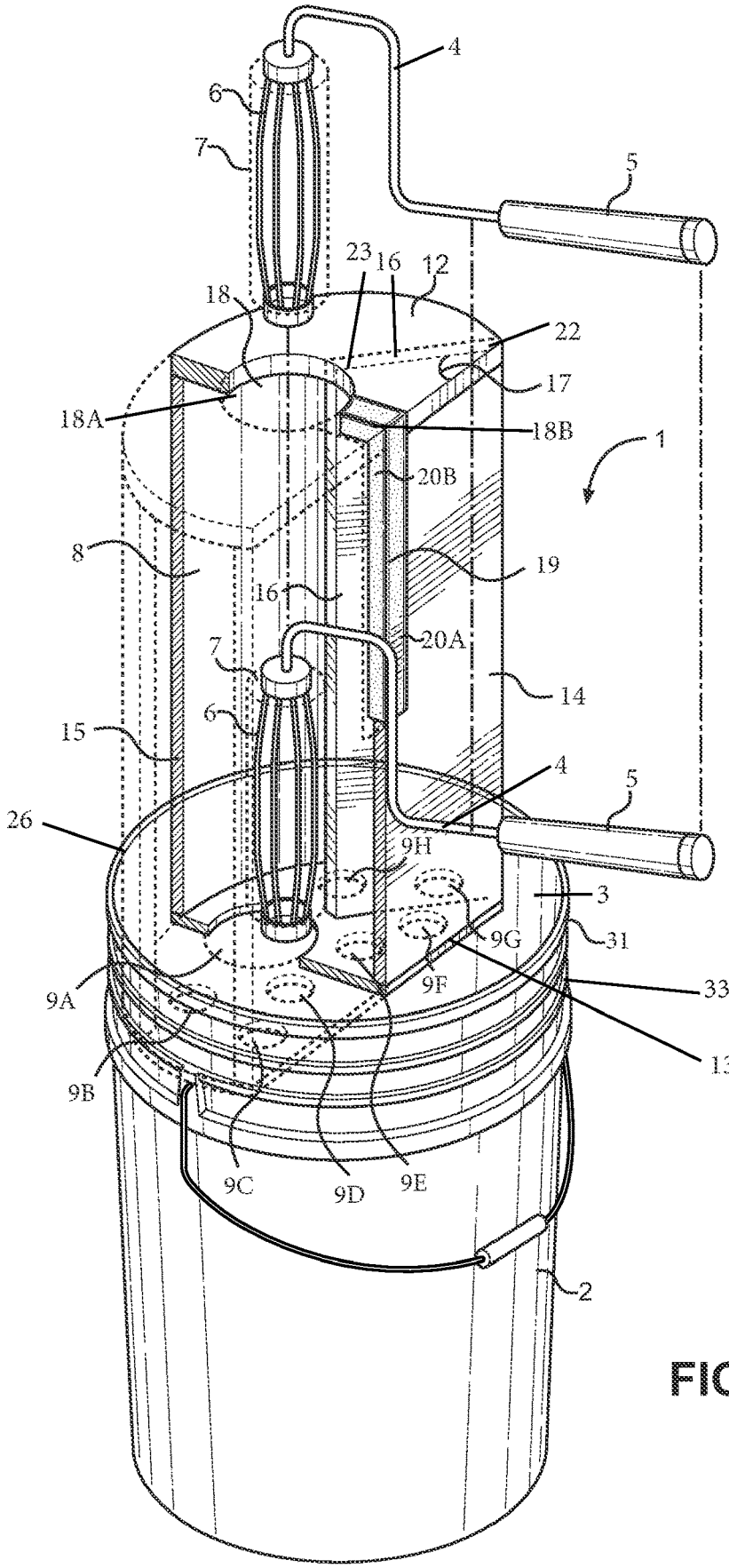
FIG. 6 is an exploded cut-away view of the novel paint roller housing receiving a paint roller cover, the housing has a tapered configuration and is received by an opening of a bucket.
Figure 8:
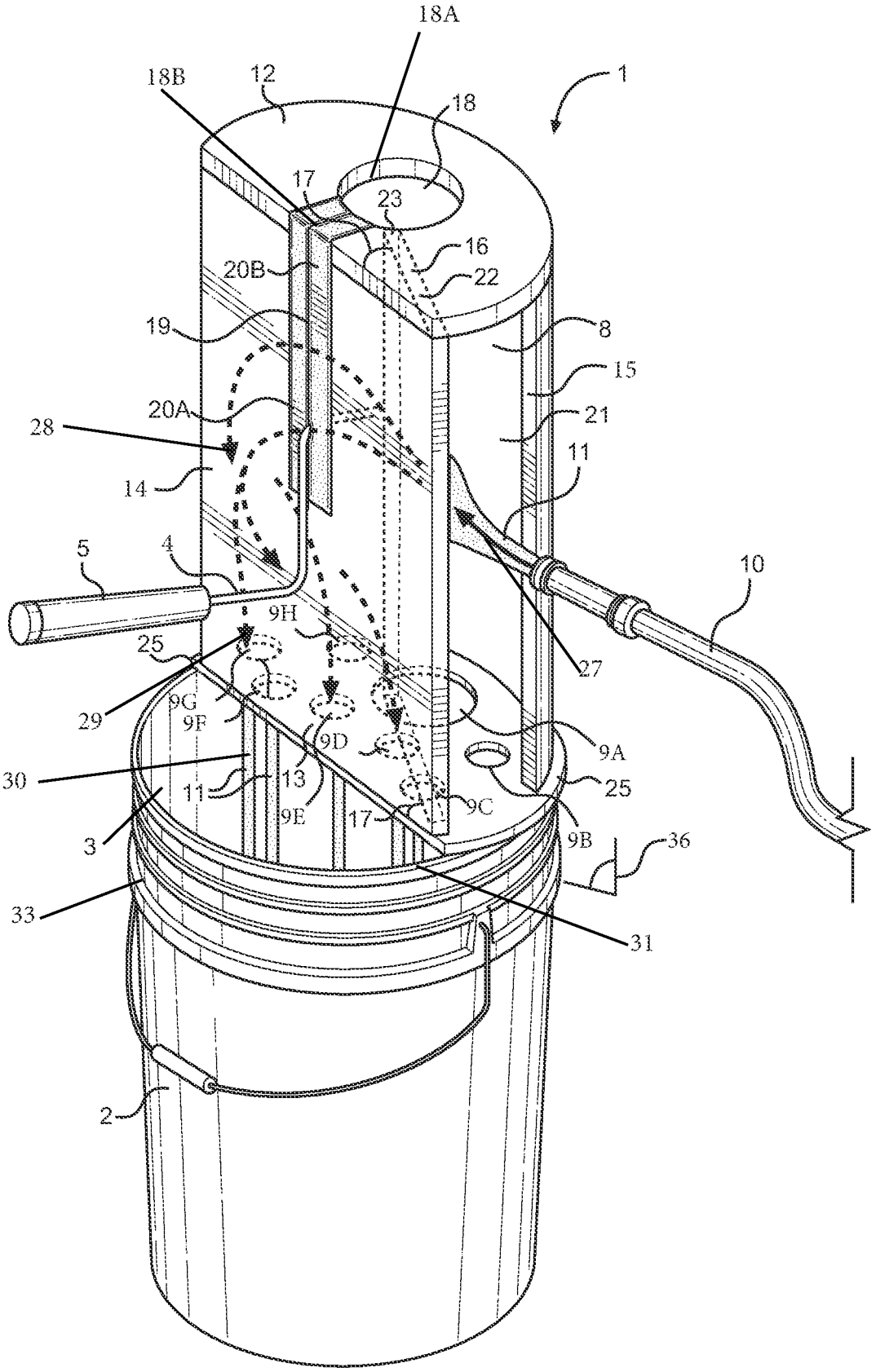
FIG. 8 is a sectional view of the novel paint roller housing having a flange and receiving a paint roller as water is being directed into an opening of the housing and guided through the housing chamber by the guide ramp, the housing is removably connected to a bucket; and, FIG. 9 is a sectional top view of the novel paint roller housing having a chamber, a guide ramp, and a lip.

Referring to FIGS. 1, 2, paint roller housing 1 has chamber 8. Housing 1 has first end 12 located opposite second end 13. First end 12 of housing 1 has first opening 18 (FIGS. 1-4). First opening 18 has first portion 18A having a size great enough to receive paint roller cover 7 (FIG. 6). First opening 18 has second portion 18B having a size great enough to receive paint roller frame 4 (FIGS. 6 and 8). First portion 18A (FIGS. 1-4) of first opening 18 has a diameter being greater in size than the opening width of second portion 18B of first opening 18.

Figure 7:
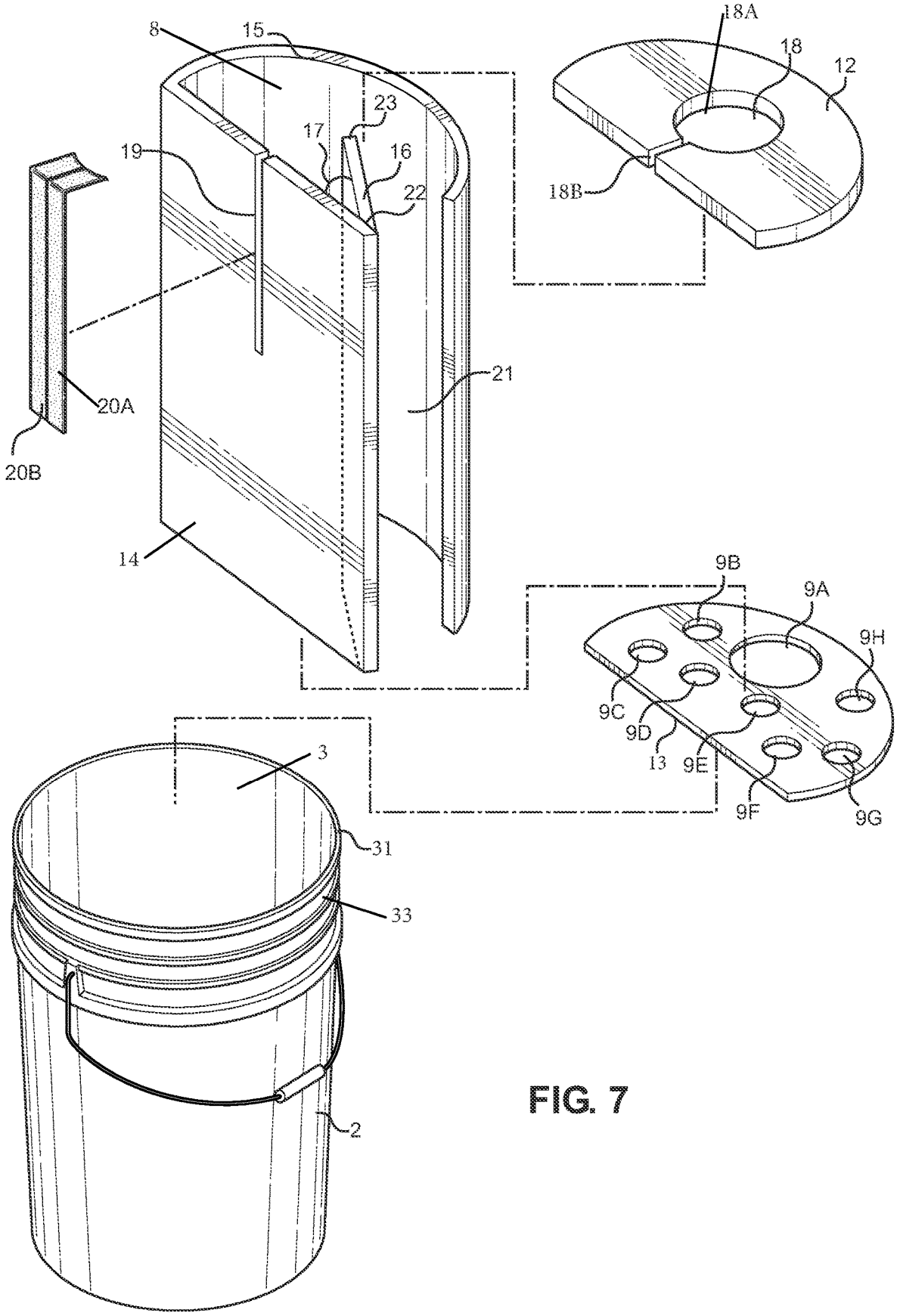
FIG. 7 is an exploded view of the novel paint roller housing connected to a bucket.

Second end 13 (FIGS. 1, 2, 5, 6, 7, and 8) of housing 1 has at least one drainage port 9A-9H (FIGS. 1, 2, 5, 6, 7, and 8). It is within the scope if this invention for drainage ports 9A-9H to have any shape or size capable of expelling 29 (FIG. 8) water 11 from drainage ports 9A-9H and draining 30 (FIG. 8) water 11 from chamber 8 of housing 1 into bucket 2 (FIGS. 7-8).

Referring to FIGS. 1-8, housing 1 has substantially planar wall 14. Substantially planar wall 14 is perpendicular 24 (FIG. 1) to first end 12 and second end 13 of housing 1. Substantially planar wall 14 has second opening 19 (FIGS. 1-3 and 5-8). Second opening 19 has a size capable of receiving roller frame 4 (FIGS. 6 and 8). Paint roller has handle 5 (FIGS. 6 and 8), ribs 6 (FIG. 6) that hold or retain roller cover 7 (FIG. 6). FIG. 6 best illustrates second opening 19 has a length capable of allowing roller frame 4 (FIGS. 6 and 8) to slidable traverse substantially planar wall 14 when roller cover 7 is fully retained within chamber 8 of housing 1.

FIGS. 1, 3-8 illustrate housing 1 having sealing structure 20A and 20B bordering second portion 18A of opening 18 of first end 12 of housing 1 and bordering second opening 19 of substantially planar wall 14 of housing 1. Sealing structure 20A and 20B is configured to grip roller frame 4 and stabilize it in place while roller cover 7 is positioned within chamber 8 of housing 1. Sealing structure 20A and 20B may be made of a resilient material including, but not limited to, plastic, foam, or rubber.

Referring now to FIGS. 6 and 8, first opening 18 is configured to receive at least a portion of both paint roller frame 4 and paint roller cover 7. Paint roller cover 7 is retained by ribs 6 of roller frame 4. Paint roller frame 4 has handle portion 5 located on an opposite end from roller cover 7. Referring now to FIG. 6, second end 13 of housing 1 has plurality of openings 19A-19G. It is within the scope of this current invention for at least a portion of at least one opening 9A of second end 13 of housing 1 being positioned in alignment with first opening 18 of first end 12 of housing 1. When first opening 18 of first end 12 of housing 1, either partially or completely, overlays opening 9A of second end 13 of housing 1, this orientation allows for roller cover 7 to have at least a portion of roller cover 7 to protrude from chamber 8 of housing 1 through opening 9A of second end 13 of housing 1 when roller frame 4 traverses second opening 19 of planar wall 14 first. Cover 7 is received by chamber 8 of housing 1 when roller cover 7 is inserted into first opening 18 of first end 12 of housing 1 and roller frame 4 is inserted into second opening 19 of planar wall 14. Due to the key aspect that paint roller cover 7 may be pressed and dragged against the outer perimeter edge of opening 9A, while roller frame 4 is retained within and traverses second opening 19 of planar wall 14 and while at least a portion of roller cover 7 is positioned within chamber 8, to facilitate the removal of excess paint from roller cover 7 during the cleaning process. The paint is scrapped from cover 7 against an outer perimeter edge of opening 9A and the scrapped paint then falls into bucket 2.

FIGS. 1-8 illustrate at least a portion of second opening 19 of substantially planar wall 14 abuts second portion 18B of first opening 18 of first end 12 of housing 1. Second opening 19 is configured for paint roller frame 4 to slidably traverse the length of second opening 19 to orient paint roller cover 7 within chamber 8 (FIGS. 1, 2, 6-8) of housing 1 during use. Housing 1 has radial wall 15 (FIGS. 1, 2, 4-8) having third opening 21 (FIGS. 1, 7-8). Third opening 21 of radial wall 15 is perpendicular 24 (FIG. 1) to first opening 18 of first end 12 of housing 1 and at least one drainage port 9A-9H of second end 13 of housing 1. Third opening 21 of radial wall 15 is configured to receive 27 (FIG. 8) stream of water 11 (FIG. 8).

FIGS. 1, 2, 4-8 illustrate housing 1 having guide ramp 16 located within chamber 8 of housing 1. Guide ramp 16 has first end 22 located opposite second end 23. First end 22 of guide ramp 16 abuts and borders third opening 21 of radial wall 15. At least a portion of second end 23 of guide ramp 16 abuts or borders first portion 18A of first opening 18 of first end 12 of housing 1. Guide ramp 16 is configured to guide 28 (FIG. 8) stream of water 11 within chamber 8 of housing 1. FIGS. 6-8 best show guide ramp forming an angle 17 with planar wall 14. It is within the scope of this invention for angle 17 to have a range between 5 degrees and 75 degrees, as this range of angles will be best suitable to guide water 11 entering chamber 8 from third opening 21 from water source such as, hose 10 (FIG. 8) within chamber 8 of housing 1.

Figure 9:
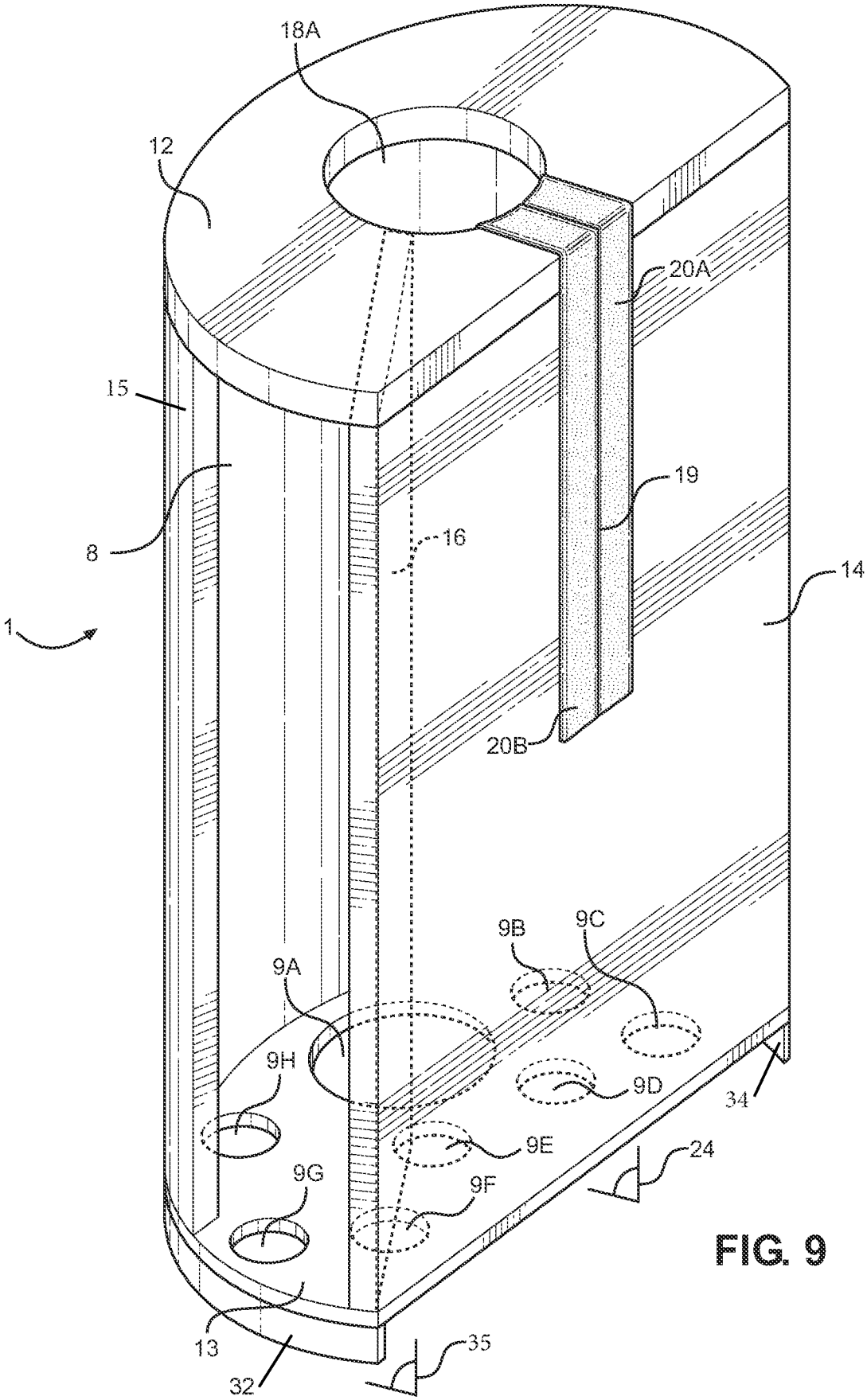

FIGS. 6-8 best illustrate outer perimeter edge 31 of bucket 2. Housing 1 is configured to be removably connected to bucket 2. Second end 13 of housing 1 has flange 25 (FIG. 8). Flange 25 is perpendicular 36 (FIG. 8) to radial wall 15 and bucket 2. Second end 13 of housing 1 is greater in size than first end 12 of housing 1. FIG. 9 illustrates an embodiment of housing 1 in which lip 32 extends from at least a portion of an outer perimeter edge of second end 13 of housing 1. Lip 32 is parallel 35 (FIG. 9) to radial wall 15 and to bucket 2. Lip 32 has inner wall surface 34 configured to be connected to at least a portion of outer wall surface 33 (FIGS. 6-8) of bucket 2.

It is within the scope of this inventions for housing 1 having sealing structure 20A and 20B bordering second opening 19 of planar wall 14 of housing 1.

It is within the scope of this invention for second end 13 of said housing having a plurality of drainage ports.

It is within the scope of this invention for housing 1 to be removably connected to an outer perimeter edge 31 (FIG. 8) bordering opening 3 (FIG. 8) of bucket 2. Second end 13 of housing 1 has flange 25 (FIG. 8) removably connected to bucket 2. Flange 25 allows housing 1 to overlay bucket 2 and orient plurality of drainage ports 9A-9H so that water 11 drains 30 (FIG. 8) from housing 1 into bucket 2.

It is within the scope of this invention for housing 1 to have tapered portion 26 (FIG. 6). Tapered portion 26 includes radial wall 15, second end 13 of housing 1, and planar wall 14. This tapered 26 configuration allows second end 13 of housing 1 to be fully retained by bucket 2. At least a portion of housing 1 is retained within the chamber of bucket 2 while at least a portion of opening 21 of radial wall, first opening 18A of first end 12, and second opening 18B of first end 12 are not concealed by bucket 2 to allow access of paint roller to be received by chamber 8 of housing 1.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

The invention claimed is:

1. A paint roller housing, comprising:

a housing, said housing having a chamber, said housing comprising:

a first end located opposite a second end, said first end of said housing having a first opening, said first opening is configured to receive at least a portion of both a paint roller frame and a paint roller cover, said second end of said housing having at least one drainage port;

a substantially planar wall, said substantially planar wall is perpendicular to said first end and said second end of said housing, said substantially planar wall having a second opening, at least a portion of said second opening of said substantially planar wall abuts said first opening of said first end of said housing, whereby, said second opening is configured for said paint roller frame to slidably traverse said length of said second opening to orient said paint roller cover within said chamber of said housing;

a radial wall, said radial wall having a third opening traversing through the radial wall, said third opening of said radial wall is perpendicular to said first opening of said first end of said housing and said at least one port of said second end of said housing, said third opening of said radial wall is configured to receive a stream of water; and, a guide ramp, said guide ramp located within said chamber of said housing, whereby, said guide ramp having a first end located opposite a second end, said first end of said guide ramp abuts said third opening of said radial wall, at least a portion of said second end of said guide ramp abuts said first opening of said first end of said housing, said guide ramp is configured to guide said stream of water within said chamber of said housing, the guide ramp forming an angle have a range between 5 degrees and 75 degrees with the substantially planar wall, the guide ramp is configured to guide said stream of water entering the chamber from the third opening.

2. The paint roller housing of claim 1, further comprising:

said housing having a sealing structure bordering said second opening of said planar wall of said housing.

3. The paint roller housing of claim 1, further comprising:

said second end of said housing having a plurality of drainage ports.

4. The paint roller housing of claim 1, further comprising:

said housing is removably connected to an outer perimeter edge bordering an opening of a bucket.

5. The paint roller housing of claim 1, further comprising:

said housing is removably connected to a bucket, said housing having a tapered end portion, whereby, said second end of said housing is retained by said bucket.

6. A paint roller housing, comprising:

a housing, said housing having a chamber, said housing comprising:

a first end located opposite a second end, said first end of said housing having a first opening, said first opening is configured to receive at least a portion of both a paint roller frame and a paint roller cover, said second end of said housing having at least one drainage port;

a substantially planar wall, said substantially planar wall is perpendicular to said first end and said second end of said housing, said substantially planar wall having a second opening, at least a portion of said second opening of said substantially planar wall abuts said first opening of said first end of said housing, whereby, said second opening is configured for said paint roller frame to slidably traverse said length of said second opening to orient said paint roller cover within said chamber of said housing;

a radial wall, said radial wall having a third opening traversing through the radial wall, said third opening of said radial wall is perpendicular to said first opening of said first end of said housing and said at least one port of said second end of said housing, said third opening of said radial wall is configured to receive a stream of water;

a guide ramp, said guide ramp located within said chamber of said housing, whereby, said guide ramp having a first end located opposite a second end, said first end of said guide ramp abuts said third opening of said radial wall, at least a portion of said second end of said guide ramp abuts said first opening of said first end of said housing, said guide ramp is configured to guide said stream of water within said chamber of said housing, the guide ramp forming an angle have a range between 5 degrees and 75 degrees with the substantially planar wall, the guide ramp is configured to guide said stream of water entering the chamber from the third opening; and, said housing is configured to be removably connected to a bucket, said second end of said housing having a flange, said flange is perpendicular to said radial wall, whereby, said second end of said housing is greater in size than said first end of said housing.

7. The paint roller housing of claim 6, further comprising:

said housing having a sealing structure bordering said second opening of said planar wall of said housing.

8. The paint roller housing of claim 6, further comprising:

said second end of said housing having a plurality of drainage ports.

9. A paint roller housing, comprising:

a housing, said housing having a chamber, said housing comprising:

a first end located opposite a second end, said first end of said housing having a first opening, said first opening is configured to receive at least a portion of both a paint roller frame and a paint roller cover, said second end of said housing having at least one drainage port;

a substantially planar wall, said substantially planar wall is perpendicular to said first end and said second end of said housing, said substantially planar wall having a second opening, at least a portion of said second opening of said substantially planar wall abuts said first opening of said first end of said housing, whereby, said second opening is configured for said paint roller frame to slidably traverse said length of said second opening to orient said paint roller cover within said chamber of said housing;

a radial wall, said radial wall having a third opening traversing through the radial wall, said third opening of said radial wall is perpendicular to said first opening of said first end of said housing and said at least one port of said second end of said housing, said third opening of said radial wall is configured to receive a stream of water;

a guide ramp, said guide ramp located within said chamber of said housing, whereby, said guide ramp having a first end located opposite a second end, said first end of said guide ramp abuts said third opening of said radial wall, at least a portion of said second end of said guide ramp abuts said first opening of said first end of said housing, said guide ramp is configured to guide said stream of water within said chamber of said housing, the guide ramp forming an angle have a range between 5 degrees and 75 degrees with the substantially planar wall, the guide ramp is configured to guide said stream of water entering the chamber from the third opening; and, a lip, said lip extending from at least a portion of an outer perimeter edge of said second end of said housing, said lip is parallel to said radial wall, said lip having an inner wall surface configured to be connected to at least a portion of an outer wall surface of a bucket.

10. The paint roller housing of claim 9, further comprising:

said housing having a sealing structure bordering said second opening of said planar wall of said housing.

11. The paint roller housing of claim 9, further comprising:

said second end of said housing having a plurality of drainage ports.

* * * * *